US007065218B2

(12) United States Patent
Schobben

(10) Patent No.: US 7,065,218 B2
(45) Date of Patent: Jun. 20, 2006

(54) METHOD OF GENERATING A LEFT MODIFIED AND A RIGHT MODIFIED AUDIO SIGNAL FOR A STEREO SYSTEM

(75) Inventor: Daniel Willem Elisabeth Schobben, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 53 days.

(21) Appl. No.: 10/478,739

(22) PCT Filed: May 24, 2002

(86) PCT No.: PCT/IB02/01921

§ 371 (c)(1),
(2), (4) Date: Nov. 24, 2003

(87) PCT Pub. No.: WO02/098172

PCT Pub. Date: Dec. 5, 2002

(65) Prior Publication Data

US 2004/0141619 A1 Jul. 22, 2004

(30) Foreign Application Priority Data

May 29, 2001 (EP) ..... 01202031

(51) Int. Cl.
*H04R 5/04* (2006.01)

(52) U.S. Cl. ..... 381/10; 381/310

(58) Field of Classification Search ..... 381/1, 381/310, 17, 18

See application file for complete search history.

(56) References Cited

FOREIGN PATENT DOCUMENTS

WO WO9725834 7/1997

*Primary Examiner*—Sinh Tran
*Assistant Examiner*—Walter F Briney, III
(74) *Attorney, Agent, or Firm*—Edward W. Goodman

(57) ABSTRACT

The invention relates to a method of generating a left modified and a right modified audio signal for a stereo system from multichannel audio signals ($X_L$, $X_R$, $X_{LS}$, $X_{RS}$, and $X_C$) with a left and a right channel and at least one further audio channel. According to the invention, the signal of the channel of highest energy is modified in a filter (1) with a transformation function in a first parallel branch (2) and is modified in a second filter (6) with a reverberation function in a second parallel branch (5), whereupon the modified signals are joined together in a summation unit (8).

20 Claims, 2 Drawing Sheets

Figure 1:
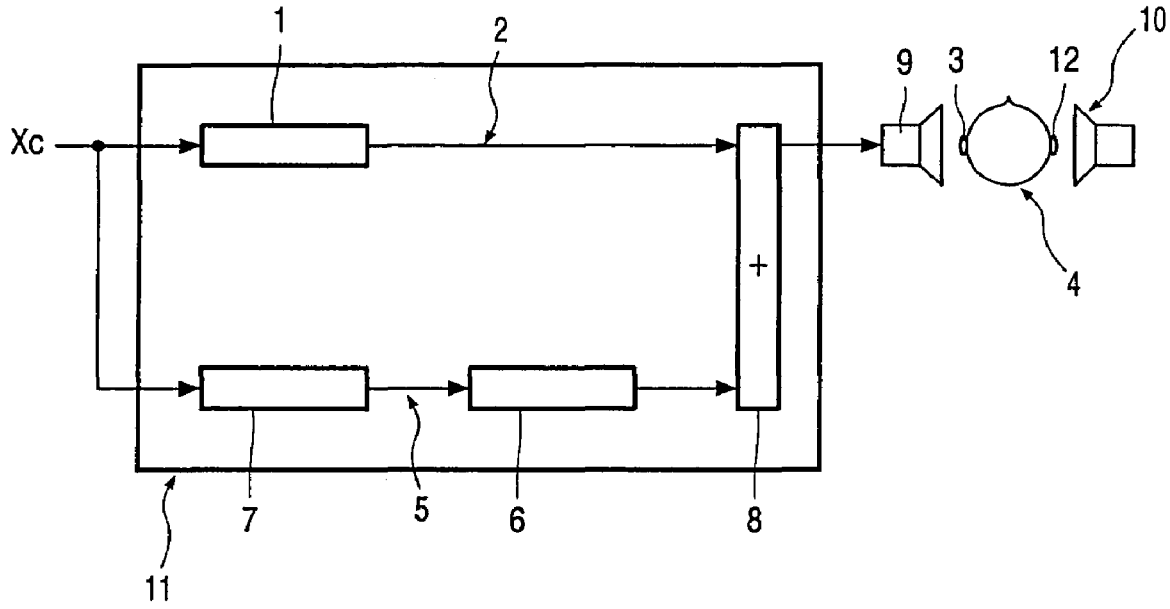

METHOD OF GENERATING A LEFT MODIFIED AND A RIGHT MODIFIED AUDIO SIGNAL FOR A STEREO SYSTEM

The invention relates to a method of generating a left modified and a right modified audio signal for a stereo system from multichannel audio signals having a left and a right channel and at least one further audio channel.

U.S. Pat. No. 5,638,451 discloses a transmission and storage method for audio signals. To achieve a compatibility between a multichannel system and stereo technique, a multichannel source coder is provided for coding multichannel audio signals. Signals from additional audio channels of the multichannel audio system are added to the left and right basic signals of the multichannel audio system, such that two modified stereo signals are created for reproduction via a stereo system.

The invention has for its object to provide a simple method for reproducing multichannel audio signals in a stereo system. In particular, a simple method and a simple circuit for reproducing the multichannel audio sound via a headphone is to be indicated.

The object is achieved by means of the characterizing features of claim 1.

According to the invention, the signal of the channel of highest energy is modified in a first parallel branch in a filter with a transformation function and in a second parallel branch in a second filter with a reverberation function, whereupon the modified signals are joined together in a summation unit. These two filters together are identical to a long filter which exactly imitates the transformation function of the central loudspeaker to the left ear. It is only the signal of highest energy which is taken into account in the generation of sound. Filters are required for one channel only.

In a simple manner, the signal of the channel of highest energy is joined together with other multichannel audio signals in a second summation unit before the modification with the transformation function. Since the low-energy signals are drowned out by the high-energy signal, the former may be passed through the same filter.

Advantageously, the signal of the channel of highest energy is joined together with other multichannel audio signals in a third summation unit before the modification with the reverberation function. The filter for the channel of highest energy may again be used for the low-energy signals because of the drowning-out effect, also for the reverberation function.

Advantageously, the transformation function is the head-related transfer function (HRTF) for the channel of highest energy. The person-related transfer function may be combined with the transformation.

In a simple manner, the reverberation function is the reverberation function of the channel of highest energy. Filters are saved in this manner.

In a simple manner, the second parallel branch comprises a time delay element for providing the reverberation with a time delay.

Advantageously, the signals of lower energy are modified by a coarse transformation function before the second summation unit.

Advantageously, the coarse transformation function is the head-related transfer function of the respective channel. The generation of the associated individual transformation function can be realized with a small calculation or computer effort.

The invention is based on the assumption that the requirements imposed on the accuracy of sound reproduction should be very stringent if only few channels are used, in other words, each sound is to be reproduced via a virtual loudspeaker. Five-channel DVD signals are reproduced via a five-channel loudspeaker set or by means of five virtual loudspeakers through a set of headphones. DVD is short for digital versatile disc. If five channels of a DVD arrangement are used, the requirements imposed on the quality of the generation of the signals for the sound sources involved may be appreciably less because of the reception through (no more than) two ears. When five virtual loudspeakers are simulated through headphones, simple approximations require 5×½ times as much processing time as virtual stereo through headphones. The calculation capacity is only fully loaded when the audio device is set for the 5-channel mode. The availability of such a capacity, i.e. the use and incorporation of processors of high power, is comparatively expensive and not very useful if such an audio device is mostly used merely for a virtual stereo reproduction through headphones.

A saving is made in calculation capacity through a simplification of those filters which are used for generating several virtual loudspeakers through headphones. Five virtual loudspeakers are simulated in a DVD arrangement. Filters of better quality are utilized when virtual stereo is generated through headphones. The resulting calculation capacity for five virtual DVD loudspeakers is comparable to that of a virtual stereo headphone system, which means that the calculation capacity is utilized to the same extent in both cases.

The filters used for generating virtual loudspeakers through headphones may be subdivided into various segments of decreasing importance. The subdivision of the segments for the sound reproduction takes place in dependence on the number of virtual loudspeakers to be generated. This leads to a constant calculation capacity in combination with a substantially constant perceivable quality. A coarse construction of the filters leads to a saving in calculation capacity.

Figure 2:
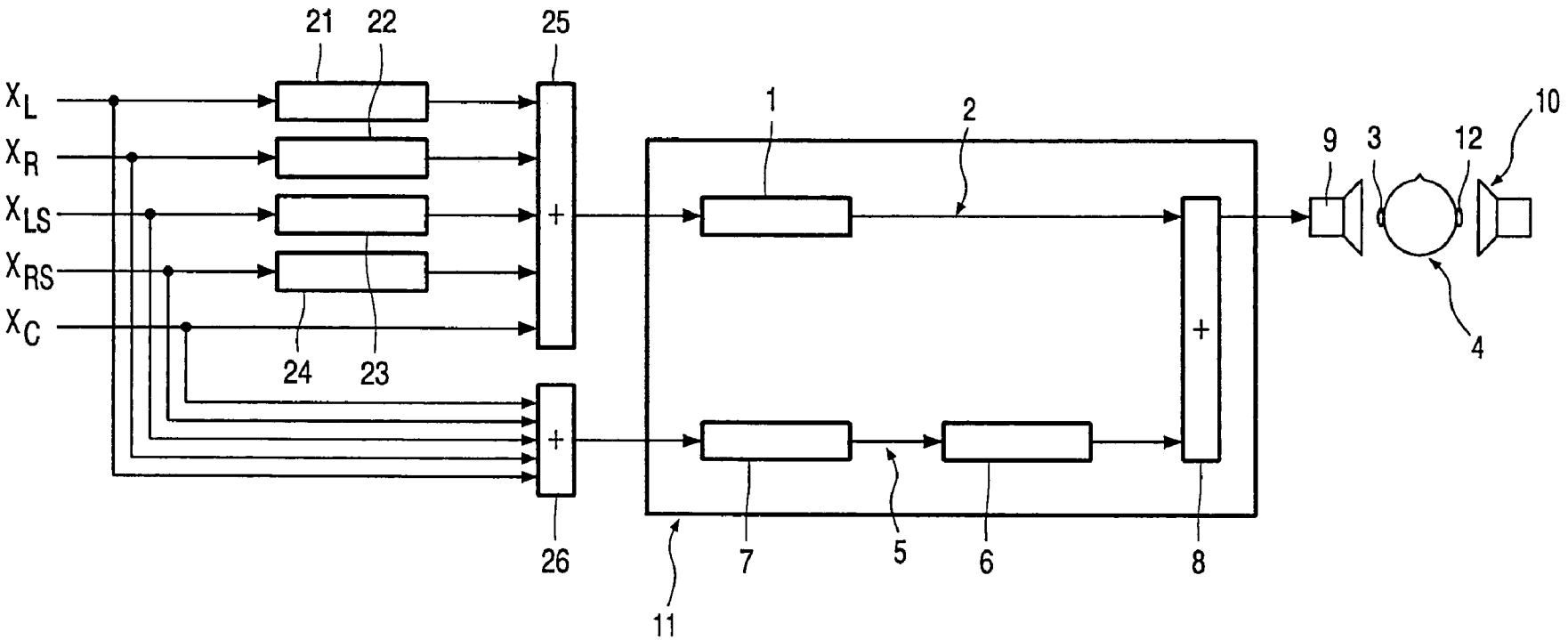

Embodiments of the invention will be explained in more detail below for better understanding, with reference to the drawing, in which:

FIG. 1 shows a circuit for sound generation at a left ear by means of an audio signal from a channel of high energy, and FIG. 2 shows a circuit for sound generation at a left ear by means of several multichannel audio signals.

FIG. 1 shows a short filter 1 in a parallel branch 2, which filter incorporates the head-related transfer function for a signal Xc of a central channel to a left ear 3 of a person 4. In a second parallel branch 5, a long filter 6 is arranged by means of which a reverberation can be generated. A time delay element 7 is also incorporated in the parallel branch 5, such that the reverberation arrives later than the HRTF. An adder 8, denoted summation unit hereinafter, adds the signals coming from the filters 1 and 6 and applies the added signal to a left loudspeaker 9 of a set of headphones 10. The two filters 1 and 6, the time delay element 7, and the summation unit 8 are identical to a long filter 11 which exactly simulates the transformation function of a central loudspeaker for the left ear 3. The sound generation for a right ear 12 may be derived in an analogous manner.

FIG. 2 shows a DVD sound generation with five channels with the same filter 11. The filter 11 may alternatively be replaced by a processor with a suitable software. Signals $X_L$, $X_R$, $X_{LS}$ and $X_{RS}$ are applied to a summation unit 25 via respective filters 21, 22, 23 and 24. The filtered signals $X_L$, $X_R$, $X_{LS}$ and $X_{RS}$ and the unfiltered signal $X_C$ are added in the summation unit 25 and provided to the filter 1. The filters 21 to 24 for the left, right, left surround, and right surround sound channels are realized with low technical expenditure and are of very simple construction. The filters 21 to 24 are connected in series with the filter 1 realized with high technical expenditure for the central channel, which latter filter supplies a high quality. The virtual left, right, left surround, and right surround loudspeakers have thus been added without a significant increase in complexity. All virtual loudspeakers are added in a further adder 26 and share the reverberation filter 6 of the central channel. This does not detract from the perceivable quality because the reverberation hardly contains any directional information, and the central channel drowns out the other channels because it typically contains very much energy. The filters 21 to 24 merely contain a time delay and a modification as to sound strength or a spectral change and coarsely resemble the original HRTFs. An approximate resemblance is sufficient because the central channel drowns out the other channels. It should be noted that the generation of the central channel in this ambience is exact, and the total complexity resembles that of the one-channel realization of FIG. 1. This method may be implemented to advantage with digitized signals. All appliances used, in particular the filters and the summation units, are of a digital construction and may thus process the digital signals in a simple manner.

Simple measurements render it possible to determine the channel of highest energy at any moment, and the corresponding HRTF may be selected in dependence on this channel. The implementation may be dynamically modified in dependence on the energy levels of the individual channels. In this manner the channel of highest energy may be reproduced with the highest quality at each and every moment.

The circuit may be comprised in portable DVD playback devices, but alternatively in all other audio devices with a headphone output and a multichannel audio system.

LIST OF REFERENCE NUMERALS

1 short filter
2 first parallel branch
3 left ear
4 person
5 second parallel branch
6 long filter
7 time delay element
8 adder (summation unit)
9 left loudspeaker
10 headphones
11 filter
12 right ear
21 simple filter
22 simple filter
23 simple filter
24 simple filter
25 adder
26 adder

The invention claimed is:

1. A method of generating virtual sound signals from multi-channel audio signals, the method comprising the steps of:

determining, from the multi-channel audio signals, at least one signal of relative highest energy;

filtering the remaining audio signals of the multi-channel audio signals not being determined as the at least one signal of relative highest energy of the multi-channel audio signals;

first summing said at least one signal of the relative highest energy with, if any, the filtered remaining audio signals thereby forming a first summed signal; and transforming the first summed signal into a virtual sound signal.

2. The method as claimed in claim 1, characterized in that said transforming step is based on head-related transfer function (HRTF) filtering and on applying a reverberation function.

3. The method as claimed in claim 2, characterized in that said transforming step is based on the head-related transfer function (HRTF) for the at least one channel carrying the at least one signal of relative highest energy.

4. The method as claimed in claim 2, characterized in that said transforming step is based on applying the reverberation function of the at least one channel carrying the at least one signal of relative highest energy.

5. The method as claimed in claim 2, characterized in that said method further comprises the step of:

second summing said at least one signal of relative highest energy with the remaining audio signals thereby forming a second summed signal, and wherein the transforming step transforms the first summed signal and the second summed signal into the virtual sound signal.

6. The method as claimed in claim 5, wherein said transforming step comprises the sub-steps:

head-related transfer function (HRTF) filtering said first summed signal; and applying the reverberation function to said second summed signal thereby forming a reverberation signal.

7. The method as claimed in claim 6, wherein said transforming step further comprises the sub-step:

third summing the filtered first summed signal and the reverberation signal to form the virtual sound signal.

8. The method as claimed in claim 7, wherein said transforming step further comprises the sub-step:

time-delaying said reverberation signal prior to said third summing sub-step.

9. The method as claimed in claim 1, the filtering step of the remaining audio signals uses coarse transformation function.

10. The method as claimed in claim 9, wherein the coarse transformation function is the head-related transfer function of the respective channels of the remaining audio signals.

11. An apparatus for generating virtual sound signals from multi-channel audio signals, the apparatus comprising:

means for determining, from the multi-channel audio signals, at least one signal of relative highest energy;

filters for filtering the remaining audio signals of the multi-channel audio signals not being determined as the at least one signal of relative highest energy of the multi-channel audio signals;

a first summing device for summing said at least one signal of the relative highest energy with, if any, the filtered remaining audio signals thereby forming a first summed signal; and a transform circuit for transforming the first summed signal into a virtual sound signal.

12. The method as claimed in claim 11, characterized in that said transform circuit comprises:

means for performing head-related transfer function (HRTF) filtering; and means for applying a reverberation function.

13. The apparatus as claimed in claim 12, characterized in that the filtering performed by said means for performing head-related transfer function filtering is based on the head-related transfer function (HRTF) for the at least one channel carrying the at least one signal of relative highest energy.

14. The apparatus as claimed in claim 12, characterized in that said the reverberation function applied by said means for applying a reverberation function is based on the reverberation function of the at least one channel carrying the at least one signal of relative highest energy.

15. The apparatus as claimed in claim 12, characterized in that said apparatus further comprises:

a second summing device for summing said at least one signal of relative highest energy with the remaining audio signals thereby forming a second summed signal, and wherein the transform circuit transforms the first summed signal and the second summed signal into the virtual sound signal.

16. The apparatus as claimed in claim 15, wherein said transform circuit comprises:

a head-related transfer function (HRTF) filter for filtering said first summed signal, and a reverberation circuit for applying the reverberation function to said second summed signal thereby forming a reverberation signal.

17. The apparatus as claimed in claim 16, wherein said transform circuit further comprises:

a third summing device for summing the filtered first summed signal and the reverberation signal to form the virtual sound signal.

18. The apparatus as claimed in claim 17, wherein said transform circuit further comprises:

a delay circuit for time-delaying said reverberation signal prior to application to said third summing device.

19. The apparatus as claimed in claim 11, wherein the filters have coarse transformation functions.

20. The apparatus as claimed in claim 19, wherein the coarse transformation functions are the head-related transfer functions of the respective channels of the remaining audio signals.

* * * * *